United States Patent [19]

Gibson

[11] Patent Number: 4,478,656

[45] Date of Patent: Oct. 23, 1984

[54] URETHANE COMPOUNDS AND CMDB PROPELLANTS STABILIZED THEREWITH

[75] Inventor: James D. Gibson, Cumberland, Md.

[73] Assignee: Hercules Incorporated, Wilmington, Del.

[21] Appl. No.: 413,401

[22] Filed: Nov. 14, 1973

[51] Int. Cl.[3] ..... C06B 45/10

[52] U.S. Cl. ..... 149/19.4; 149/38; 149/42; 149/44; 149/76; 149/92; 149/95; 149/98; 524/199

[58] Field of Search ..... 149/19.4, 38, 42, 44, 149/76, 92, 95, 98; 260/482, 471 C, 479 C; 524/199

[56] References Cited

U.S. PATENT DOCUMENTS 3,790,416 2/1974 Dehm ..... 149/19.4

*Primary Examiner*—Stephen J. Lechert, Jr.
*Attorney, Agent, or Firm*—Edmund C. Ross, Jr.

[57] ABSTRACT

Certain urethane compounds containing m-phenylene substituents are useful as stabilizers for composite modified double base (CMDB) propellants. Examples of these novel urethanes are 1,3-bis(N-methoxyphenylurethane)benzene, 1,3-bis(N-m-tolylurethane)benzene, 1,3-bis(N-m-chlorophenylurethane)benzene, 1,3-bis(N-m-phenylurethane)benzene, 1,3-bis(N-ethylurethane)benzene and bis(m-methoxyphenyl)urethane.

13 Claims, No Drawings

URETHANE COMPOUNDS AND CMDB PROPELLANTS STABILIZED THEREWITH

This invention relates to novel urethane materials and to composite modified double-base propellants (CMDB) stabilized therewith.

Composite modified double-base propellants are prepared from nitrocellulose, an explosive or energetic plasticizer, which is usually nitroglycerin, a solid organic or inorganic oxidizer and a metal fuel. Composite modified double-base propellants can be prepared by known methods including conventional casting processes.

In the slurry casting process for CMDB propellant a crosslinking agent is employed to crosslink the nitrocellulose binder to improve the physical properties of the propellant. Commonly used crosslinking agents are isocyanates. A stabilizer is employed in double-base and CMDB propellants to react with nitrogen oxides which form as a result of gradual degradation of the propellant, to prolong its usable life. One of the most widely employed stabilizers for double-base propellant is resorcinol. Resorcinol is reactive with isocyanate crosslinking agents employed in CMDB propellant. As a result of this reaction it is difficult to predict the amount of isocyanate crosslinking agent required to produce the desired physical properties of resorcinol stabilized CMDB propellant.

Now, in accordance with this invention, it has been found that certain novel urethane materials are effective stabilizers for CMDB propellants. The urethanes of this invention do not react with isocyanate and therefore are particularly useful as stabilizers for CMDB propellants crosslinked with isocyanate.

Accordingly, this invention relates to urethanes and CMDB propellants stabilized therewith. The urethanes of this invention are of the formula:

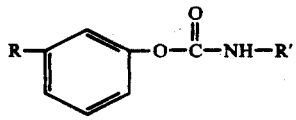

wherein

R is selected from the group consisting of (a) —$OCH_3$, and (b) radicals of the formula

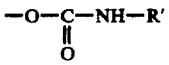

wherein

R′ is $C_1$ to $C_4$ alkyl or

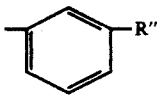

wherein

R″ is —$OCH_3$, —$CH_3$, Cl or H. In the above formulas, when R is —$OCH_3$, R′ is

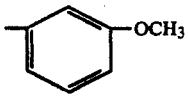

Illustrative of the urethanes which can be used in accordance with this invention as a stabilizer for CMDB propellants are 1,3-bis(N-methoxyphenylurethane)benzene, 1,3-bis(N-m-tolylurethane)benzene, 1,3-bis(N-m-chlorophenylurethane)benzene, 1,3-bis(N-m-phenylurethane)benzene, 1,3-bis(N-ethylurethane)benzene, and bis(m-methoxyphenyl)urethane.

The urethane stabilizers can be prepared by reacting a suitable phenolic material such as resorcinol or m-methoxyphenol with a suitable isocyanate. Illustrative isocyanates which can be used as m-methoxyphenyl isocyanate, m-tolylisocyanate, ethyl isocyanate, m-chlorophenyl isocyanate, m-phenylisocyanate, and the like.

The reaction preferably takes place in an organic nonpolar solvent, for example, benzene, toluene, xylene, and the like. The temperature at which the reaction conducted is in the range of about 80° C. to about 135° C., preferably about 80° C. to about 100° C. and requires about 5 to about 20 hours for completion depending on the amount of catalyst, and the reaction temperature employed. A catalyst, such as a soluble tin compound is used to promote the reaction. Preferred catalysts are dibutyl tin dilaurate, dibutyl tin diacetate, and the like. The amount of catalyst used is from about 0.5 to about 1% based on the weight of the active ingredients.

The urethanes are useful as stabilizers for CMDB propellants. The amount of urethane stabilizer incorporated into the CMDB propellant formulation is from about 0.5 parts by weight to about 2 parts by weight, based on the weight of the propellant formulation, and is preferably from about 0.7 to about 1.5 parts by weight.

The preferred energetic plasticizer in CMDB propellant is nitroglycerin but other energetic plasticizers can also be used. Illustrative energetic plasticizers are nitrate esters such as trimethylolethane trinitrate; diethyleneglycol dinitrate; triethyleneglycol dinitrate; 1,2,4-butanetriol trinitrate; bis(dinitropropyl) acetal; bis(dinitropropyl) formal; glycerol monolactate trinitrate; glycol dinitrate; nitroisobutylglycerol trinitrate; and the like.

The solid oxidizer employed in CMDB propellant can be an inorganic or organic oxidizing agent. Illustrative inorganic oxidizing agents are ammonium perchlorate, and ammonium, alkali metal, or alkaline earth metal nitrates which can be used alone or in mixtures with other inorganic oxidizing salts such as chromates, dichromates, permanganates, chlorates and perchlorates of the alkali or alkaline earth metals or ammonia. Organic oxidizing agents which can be used include cyclotrimethylene trinitramine, cyclotetramethylene tetranitramine, pentaerythritol tetranitrate, dipentaerythritol hexanitrate, ethylene dinitramine, 2,4,2′,4′-tetranitro-oxanilide, 2,4,6,2′,4′,6′-hexanitro-oxanilide, mannitol hexanitrate, nitroguanidine, lead 2,4-dinitroresorcinate, lead 4,6-dinitroresorcinate, trinitrotoluene, as well as mixtures thereof with each other or with one or more inorganic oxidizing salts.

Metal fuels which can be employed in CMDB propellants include aluminum, aluminum hydride, beryllium, beryllium hydride, zirconium, and the like. Other well known additives such as processing aids, wetting agents, and the like can also be present in the propellant formulations.

Isocyanates which can be used as crosslinking agents in the preparation of CMDB propellants include any isocyanate which crosslinks nitrocellulose. Illustrative isocyanates which can be used are aliphatic and aromatic diisocyanates, such as ethylene diisocyanate, trimethylene diisocyanate, propylene-1,2-diisocyanate, hexamethylene diisocyanate, 1-propylene-1,2-diisocyanate, ethylidene diisocyanate, cyclohexylene-1,2-diisocyanate, cyclopentylidene diisocyanate, tolyl diisocyanate, naphthylene-1,4-diisocyanate, xylylene-1,3-diisocyanate and the like. The foregoing list is in no way limiting to the isocyanate crosslinking agent that can be used in the preparation of CMDB propellants.

The following examples illustrate the method of preparation of the urethane stabilizers, and their use in CMDB propellants. In these examples all parts and percentages are by weight unless otherwise specified.

EXAMPLE 1

This example illustrates the preparation of 1,3-bis(N-m-methoxyphenyl urethane)benzene. A 3-neck flask equipped with a thermometer, a dropping funnel, a reflux condenser, an electric heating mantle and a magnetic stirrer is charged with 61.4 parts (0.58 mol) of resorcinol and 1320 parts of dry reagent grade benzene along with 1.2 parts (0.5% of active ingredients) of dibutyl tin dilaurate dissolved in 10 parts of benzene. Then 179 parts (1.20 mol) of m-methoxyphenyl isocyanate is mixed with 422 parts of dry reagent grade benzene in a liter beaker and the solution is poured into the dropping funnel. The contents of the reactor are heated to refluxing (79.0° C.) and the isocyanate solution is added to the reactor from the dropping funnel over a period of 96 minutes. Some solid product forms about 17 minutes after the addition of the isocyanate solution. The mixture is refluxed 57 hours to ensure that the reaction is complete. The solid product is filtered and washed three times with dry benzene. The product is dried in vacuum. The melting point of the dried product is 144.9°–145.0° C. The product is 1,3-bis(N-m-methoxyphenyl urethane)benzene.

EXAMPLE 2

This example illustrates the preparation of 1,3-bis(N-m-tolylurethane)benzene. The apparatus described in Example 1 is charged with 11.1 parts (0.1 mol) resorcinol, 220 parts of dry reagent grade benzene, and 0.40 parts dibutyl tin dilaurate dissolved in a small amount of benzene. Then 27.9 parts (0.21 mol) of m-tolylisocyanate is dissolved in 70 parts of dry benzene and poured into the dropping funnel. The reactor contents are heated to benzene refluxing temperature (80° C.), and then the isocyanate solution is slowly added to the reactor from the dropping funnel over a period of 39 minutes. The mixture is refluxed at 80° C. for a total of 47 hours. The product remains in the solution at 80° C. The mixture is cooled to room temperature and a solid product precipitates. The solid product is filtered and washed three times with benzene and dried. The dried product is 1,3-bis(N-m-tolylurethane)benzene. The melting point of this product is 140.5°–142° C.

EXAMPLE 3

This example illustrates the preparation of 1,3-bis(N-ethyl urethane)benzene. The apparatus described in Example 1 is charged with 278 parts (2.5 mol) of resorcinol in 5520 parts of dry benzene containing 3.2 parts of dibutyl tin dilaurate catalyst. The reactor contents are heated to refluxing (80° C.) and a solution of 356 parts (5.0 mol) of ethyl isocyanate in 1340 parts of dry reagent grade benzene is added to the reactor from a dropping funnel over a period of 96 minutes. The reaction is permitted to continue for 19.5 hours. The reaction mixture is cooled to 20° C., and the crystalline product is filtered, washed three times with benzene, and dried. The dried product is 1,3-bis(N-ethylurethane)benzene. The melting point of the dried product is 159.5°–161° C.

Examples 4–9 illustrate the preparation of CMDB propellants by a slurry casting process using hexamethylene diisocyanate as crosslinking agent and the urethane materials of this invention as stabilizers. Example 10 is a control.

EXAMPLES 4–10

A Baker-Perkins vertical mixer equipped with an air motor stirrer, heated by circulating hot water and attached to a vacuum system is used to prepare the propellant formulations. First nitroglycerin, triacetin, 2-nitrodiphenylamine and urethane stabilizer are added to the mixer. The mixer is heated to 110° F. and the mixture is stirred remotely at 12 rpm for 20 minutes. The reactor is cooled to 80° F. Hexamethylenediisocyanate is added to the reactor and the reactor contents are mixed for five minutes at 12 rpm. Nitrocellulose is added to the reactor and the resulting mass is mixed five minutes. Organic oxidizer (cyclotetramethylenetetranitramine) is then added to the reactor and mixing is continued for five minutes. Ammonium perchlorate is then added to the reactor and mixing is continued for 5 minutes. Aluminum powder finally is added to the propellant mass and mixed under vacuum for 30 minutes. The resulting propellant is then vacuum cast into a polyethylene freezer carton. The cast propellant slurry is cured for seven days at 120° F. The formulation of the urethane stabilizer CMDB propellants is set forth in Table I.

A control CMDB propellant is prepared in Example 10 utilizing resorcinol as the stabilizing agent. This propellant is not crosslinked because of the excessive interaction between resorcinol and isocyanate crosslinking agents. The control CMDB propellant is prepared in a vertical mixer utilizing standard mixing techniques. The mixed propellant mass is cured for seven days at 140° F. The formulation of the control propellant (Example 10) is also set forth in Table I.

TABLE I

| | Composition, wt % | |
|---|---|---|
| | Exs. 4–9 | Ex. 10 |
| Nitrocellulose | 8.2 | 14.4 |
| Nitroglycerin | 19.1[a] | 32.4 |
| 2-Nitro-diphenylamine | 1.0 | 1.0 |
| Hexamethylene diisocyanate | 0.3 | — |
| Triacetin | 1.0 | 2.52 |
| Cyclotetramethylene-tetranitramine, Class B | 40.9 | 17.64 |
| Aluminum, 30μ | 20.0 | 23.4 |

TABLE I-continued

| | Composition, wt % | |
|---|---|---|
| | Exs. 4–9 | Ex. 10 |
| Ammonium Perchlorate, 200μ | 8.0 | 7.92 |
| Stabilizer | 1.5 | 0.72 |

[a]contains 1% 2-nitrodiphenylamine

The stabilizer of each propellant in Examples 4–10 is set forth in Table II.

TABLE II

| Ex. No. | Stabilizer |
|---|---|
| 4 | 1,3-bis(N—m-methoxyphenylurethane)benzene(BMUB) |
| 5 | 1,3-bis(N—m-tolylurethane)benzene(BTUB) |
| 6 | 1,3-bis(N—m-chlorophenylurethane)benzene(BCPB) |
| 7 | 1,3-bis(N—m-phenylurethane)benzene(BPB) |
| 8 | 1,3-bis(N—ethylurethane)benzene(BEUB) |
| 9 | bis(m-methoxyphenyl)urethane(m-MPU) |
| 10 | resorcinol |

The efficiencies of the stabilizers are determined by comparing the induction times for the CMDB propellants at 80° C., 100° C. and 140° C. The induction times for the CMDB propellants of this invention are set forth in Table III.

TABLE III

| | Stabilized Propellant Thermal Properties | | | | | | |
|---|---|---|---|---|---|---|---|
| Propellant Example | 4 | 5 | 6 | 7 | 8 | 9 | 10 |
| Stabilizer | BMUB | BTUB | BCPB | BPB | BEUB | m-MPU | Resorcinol |
| Induction Time | | | | | | | |
| Flammability test, 80° C., days | 68 | 29 | | 49 | 61 | 42 | 38 |
| Taliani 100° C., minutes | 8300 | 6100 | | | 5850 | 6800 | 4300 |
| DSC, 140° C., minutes | 40 | | 38 | 55 | 36 | | 32 |

The induction times at 80° C. are determined by the flammability test. In this test a one-inch cube of propellant is wrapped in aluminum foil and is placed in a $2\frac{1}{4}'' \times 2\frac{1}{2}'' \times 6''$ metal container open on one end. A wire screen and aluminum foil are used to cover the open end of the container. The container is placed in a 80° C. constant temperature oven. The container is observed every day until the propellant cube burns, as indicated by burned aluminum foil cover on the container.

The induction time at 100° C. utilizes the Taliani test method and Taliani test apparatus. This apparatus is a constant gas volume system with a glass tube connected to a mercury manometer. The glass tube is heated by an electrically heated metal block. A propellant sample of 0.01 gram is placed in the glass bulb and the heater block is raised around the sample tube. The pressure of the system resulting from gassing of the propellant due to degradation of the propellant is followed by plotting the pressure in the system against time to determine when gassing of CMDB propellant sample starts.

The induction time at 140° C. is determined on a Perkin-Elmer differential scanning calorimeter Model DSC 1B. A sample of 0.01 gram of CMDB propellant is placed in the cup of the calorimeter which is maintained at a constant temperature of 140° C. The time in minutes is measured until the propellant starts to decompose as measured by heat produced which is a measure of the stability imparted by the stabilizer.

The results of these tests are shown in Table III. These results are compared to the prior art CMDB propellant formulation comprising a noncrosslinked CMDB propellant containing resorcinol as stabilizer. The resorcinol stabilized control propellant is considered a stable propellant. The amount of resorcinol used as stabilizer is effective for stabilizing a CMDB propellant containing the indicated amount of ammonium perchlorate. Thus, comparison of induction times for the CMDB propellant of this invention with the control shows that the CMDB propellant is satisfactorily stabilized when compared to the control.

What I claim to be protected by Letters Patent is:

1. Compounds of the formula

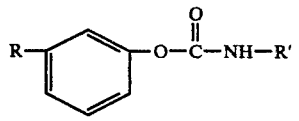

wherein

R is selected from the group consisting of (a) $—OCH_3$ and (b) radicals of the formula

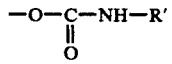

R′ is selected from the group consisting of $C_1$ to $C_4$ alkyl and

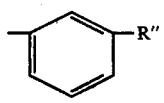

and R″ is selected from the group consisting of $—OCH_3$, $—CH_3$, Cl and H;

and when R is $—OCH_3$, R′ is

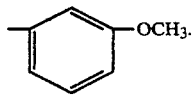

2. The compound of claim 1 in which R is $—OCH_3$ and R′ is

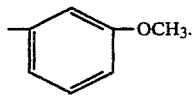

3. The compound of claim 1 in which R is

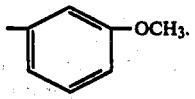

and each R′ is

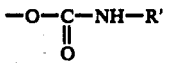

4. The compound of claim 1 in which R is

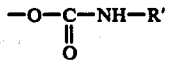

and each R′ is

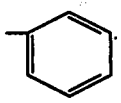

5. The compound of claim 1 in which R is

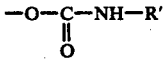

and each R′ is

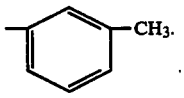

6. The compound of claim 1 in which R is

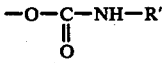

and each R′ is

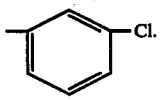

7. In a composite modified double-base propellant in which the crosslinking agent is an isocyanate, the improvement comprising a stabilizer of the formula

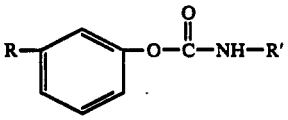

wherein

R is selected from the group consisting of (a) $-OCH_3$ and (b) radicals of the formula

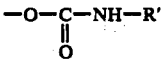

R′ is selected from the group consisting of $C_1$ to $C_4$ alkyl and

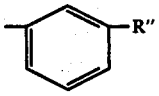

and R″ is selected from the group consisting of $-OCH_3$, $-CH_3$, Cl and H;

provided that when R is $-OCH_3$, R′ is

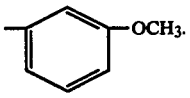

8. A propellant formulation as set forth in claim 7 wherein the stabilizer is 1,3-bis(N-m-methoxyphenylurethane)benzene.

9. A propellant formulation as set forth in claim 7 wherein the stabilizer is 1,3-bis(N-m-tolylurethane)benzene.

10. A propellant formulation as set forth in claim 7 wherein the stabilizer is 1,3-bis(N-m-chlorophenylurethane)benzene.

11. A propellant formulation as set forth in claim 7 wherein the stabilizer is 1,3-bis(N-m-phenylurethane)benzene.

12. A propellant formulation as set forth in claim 7 wherein the stabilizer is 1,3-bis(N-ethylurethane)benzene.

13. A propellant formulation as set forth in claim 7 wherein the stabilizer is bis(m-methoxyphenyl)urethane.

* * * * *

UNITED STATES PATENT AND TRADEMARK OFFICE

CERTIFICATE OF CORRECTION

PATENT NO. : 4,478,656

DATED : October 23, 1984

INVENTOR(S) : James Donald Gibson

It is certified that error appears in the above-identified patent and that said Letters Patent are hereby corrected as shown below:

Column 1, line 7 - Add after "therewith" the following sentences:

--The U.S. Government has rights in the Patent under Contract N000-17-72C-4414.--

UNITED STATES PATENT AND TRADEMARK OFFICE

CERTIFICATE OF CORRECTION

PATENT NO. : 4,478,656

DATED : October 23, 1984

INVENTOR(S) : James Donald Gibson

It is certified that error appears in the above-identified patent and that said Letters Patent are hereby corrected as shown below:

Columns 6 & 7 of Claim 3;

"3. The compound of claim 1 in which R is

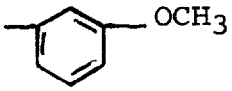

and each R' is $-O-\underset{\underset{O}{\|}}{C}-NH-R'$ should read

--3. The compound of claim 1 in which R is $-O-\underset{\underset{O}{\|}}{C}-NH-R'$ and each R' is 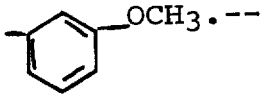 .--

Signed and Sealed this

*Twenty-third* Day of *April 1985*

[SEAL]

*Attest:*

DONALD J. QUIGG

*Attesting Officer* *Acting Commissioner of Patents and Trademarks*